US005209590A

United States Patent [19]

Tsukuda et al.

[11] Patent Number: 5,209,590

[45] Date of Patent: May 11, 1993

[54] PAPER BAILING APPARATUS FOR PRINTER

[75] Inventors: Yasunori Tsukuda; Hidetoshi Sakurai, both of Shizuoka, Japan

[73] Assignee: Star Micronics Co., Ltd., Shizuoka, Japan

[21] Appl. No.: 912,839

[22] Filed: Jul. 13, 1992

[30] Foreign Application Priority Data

Jul. 25, 1991 [JP] Japan ..... 3-186483
Mar. 30, 1992 [JP] Japan ..... 4-71924

[51] Int. Cl.[5] ..... B41J 13/02

[52] U.S. Cl. ..... 400/636.1; 400/639.1

[58] Field of Search ..... 400/639.1, 639.2, 634, 400/636, 636.1, 636.2, 637.1, 638, 645.3, 645.4, 645.5, 185, 186, 187, 320.1

[56] References Cited

U.S. PATENT DOCUMENTS

| | | | |
|---|---|---|---|
| 4,602,883 | 7/1986 | Ozawa et al. | 400/637.1 |
| 4,684,277 | 8/1987 | Edstrom et al. | 400/639.1 |
| 4,693,621 | 9/1987 | Kawaguchi | 400/636.1 |
| 4,941,762 | 7/1990 | Murakami et al. | 400/636.1 |
| 4,971,469 | 11/1990 | Nakajima | 400/636.1 |
| 5,020,929 | 6/1991 | Funamoto et al. | 400/639.1 |
| 5,046,873 | 9/1991 | Fare | 400/639.1 |
| 5,071,275 | 12/1991 | Nakayasu et al. | 400/639.1 |
| 5,078,524 | 1/1992 | Sato | 400/636.1 |
| 5,120,146 | 6/1992 | Nakayasu et al. | 400/639.1 |
| 5,135,321 | 8/1992 | Olsen et al. | 400/639.1 |

*Primary Examiner*—Eugene H. Eickholt
*Attorney, Agent, or Firm*—Koda and Androlia

[57] ABSTRACT

A paper bailing apparatus for a printer which holds paper against the platen by a bail roller. In order to drive the bail roller from the release position to the bailing position, the driving force of the paper feed gear is utilized. The paper feed gear transmits the driving force to a bail gear which rotates the bail roller through an idle gear. The idle gear is held away from the paper feed gear and the bail gear in the ordinary state. A compression piece provided on a carriage moves the bail gear to the driving position. When the carriage is moved beyond the printing range, the compression piece moves the idle gear to the driving position. Once the idle gear meshes with the paper feed gear and the bail gear, even if the carriage is moved beyond the printing range, the interlocking is continued until the bail roller is moved to the bailing position.

8 Claims, 6 Drawing Sheets

PAPER BAILING APPARATUS FOR PRINTER

BACKGROUND OF THE INVENTION

1. Field of the Invention

The present invention relates to a paper bailing apparatus for a printer and, more particularly, to a mechanism of driving a bail roller for holding paper against a platen.

2. Description of the Related Art

In a conventional printer of this type, printing paper is brought into contact with the peripheral surface of a platen, and printing on the paper is carried out by a printing head held by a carriage which reciprocates in the axial direction of the platen.

At this time, the paper is generally held against the platen by a bail roller so that the paper is in close contact with the platen when printing is carried out.

Such a bail roller is generally rotatably supported at one end of a bail lever, and after the paper is fed to the platen, the bail roller which has been held apart from the platen is moved to the bailing position.

Such a bail roller must be positioned securely at the bailing position after the paper is mounted on the platen.

At the time of inserting paper, however, the bail roller is rather a hindrance, and if the paper is inserted carelessly when the bail roller is in the bailing position, a jam will be caused.

Therefore, when roll paper or sprocket paper is inserted, the bail roller is manually moved to the release position by the user, and after the paper is securely mounted on the platen, the bail roller is manually restored to the bailing position by the user.

Recent automatic printers, however, are required to automatically drive the bail roller, and some automatic bail roller driving devices have hitherto been proposed.

Conventional automatic bail roller driving mechanisms generally have a solenoid or a motor exclusively for driving a bail lever, and when a sensor detects the insertion of paper, the solenoid or the motor is driven in accordance with a predetermined control program for moving the bail roller.

Such a conventional device requires various driving mechanisms merely for moving the bail roller, so that the size of the device is inconveniently increased, resulting in an increase in cost of the printer. An improved automatic bail roller driving device which is applicable to a recent small-sized, light-weight and inexpensive printer has therefore been demanded.

Another automatic bail roller driving mechanism conventionally proposed is a device which utilizes the carriage driving force to also drive the bail roller without providing any plunger or motor exclusively for driving the bail roller.

An example of such a mechanism is disclosed in Japanese Patent Laid-Open No. Sho 63-49465. In this mechanism, the paper feed roller rotating force is transmitted to a rotary cam through a clutch so as to rock a bail lever which is connected to the cam. The operation of connecting or disconnecting the clutch is carried out by moving the carriage beyond the printing range.

This mechanism is advantageous in that the bail roller is automatically driven without using any plunger or motor exclusively therefor, but suffers from the following problems.

(1) Even when the user manually rotates the bail lever so as to release it, since the bail lever is constantly biased toward the bailing position by a spring, it is impossible to hold the bail lever at the release position.

Therefore, when the user manually sets paper, the user must hold the bail lever so as to prevent the bail lever from being restored to the bailing position. The operability is thus poor.

(2) When the bail lever is at the release position, in other words, while the cam is holding the bail lever, the bail lever cannot be manually restored to the bailing position. If the bail lever is restored to the bailing position by force, the cam mechanism or the bail lever will be broken.

(3) Since an arm which engages the carriage and rotates in accordance with the movement of the carriage is not provided with any bending mechanism or buffer mechanism, if the amount of movement of the carriage after it engages the arm becomes too large by mistake, a part will be broken.

The carriage often moves until it hits against the frame when the control of the position of the carriage is lost, for example, when the carriage is manually moved by the user for the purpose of changing ribbons while the power source is off or when the carriage motor is out of order. In such a case, inconvenience such as breakage of the carriage, deformation of the arm and breakage of a tooth of the gear is caused.

(4) It is necessary to recognize the stopping position of the cam and initialize the cam at a predetermined position when the power source is turned on.

For this purpose, not only are the laborious operations of the carriage, the paper feed roller (platen) and the bail lever required whenever the power source is turned on, but also when the power source is turned on when paper is already mounted, the driving operation of the paper feed roller for initialization deviates the position of the paper which has been set at the right position or obstructs the normal paper feed.

Furthermore, this mechanism requires a detecting means such as an encoder for detecting the rotational position of the cam in order to control the cam, which leads to an increase in cost.

As described above, although this automatic bail roller driving mechanism dispenses with a driving source exclusively for its use, the manual operability of the bail roller by the user is sacrificed. In addition, since even a small operational error is apt to lead to breakage, this mechanism cannot be said to be satisfactory.

An automatic bail roller driving mechanism having a simpler structure while maintaining the manual operability is disclosed in Japanese Patent Laid-Open No. Sho 63-42879.

In this mechanism, the bail lever is manually driven and is held at the release position, and when the carriage is moved beyond the printing range, the carriage triggers the releasing mechanism for moving the bail lever from the release position so as to return to the bailing position.

This mechanism is advantageous in that printing is efficiently possible from the upper end of the paper, but suffers from the following problems.

Since the carriage is constantly out of the printing range when the bail lever is restored to the bailing position, the paper is horizontally asymmetrically slackened when the bail roller is pressed against the platen and at the subsequent paper feeding stage, the paper is fed obliquely, thereby causing what is called skew, in other words, printing in a skewed line.

The known skew phenomenon is generally prevented by temporarily moving the carriage to the vicinity of the center position (this operation is generally called centering) before restoring the bail lever to the bailing position, so that the bail roller is pressed against the platen while the paper is held substantially in a horizontally symmetrical position by the printing head, the guide provided on the carriage and the like.

In this automatic bailing roller driving mechanism, however, it is impossible to center the carriage before restoring the bail lever to the bailing position. Therefore, in spite of the simple structure, this mechanism possesses a major defect, namely, skew of paper.

SUMMARY OF THE INVENTION

Accordingly, it is an object of the present invention to eliminate the above-described problems in the related art and to provide a paper bailing apparatus for a printer which is capable of automatically driving a bail lever without using a driving source exclusively for its use, which does not impair the manual operability of the bail lever, and which is free from the risk of breaking a part.

It is another object of the present invention to provide a high-quality paper bailing apparatus for a printer which obviates the laborious initializing operations at the time of turning on the power source.

It is still another object of the present invention to provide a printer which is capable of high-quality printing and ensuring paper setting without causing skew.

To achieve this aim, in one aspect of the present invention there is provided a paper bailing apparatus for a printer comprising: a platen for mounting paper thereon; a paper feed gear for rotating the platen; a carriage for carrying a printing head and reciprocating in the axial direction of the platen; a bail roller supported by a rockable bail lever so as to hold the paper against the surface of the platen; a toggle spring for setting the bail lever either at the bailing position at which the bail roller is held against the platen or at the release position at which the bail roller is apart from the platen and for holding the bail lever at that position; a bail gear provided at the rocking supporting portion of the bail lever so as to receive the bail lever rocking force; an idle gear supported by a rotatable idle lever so as to be moved either to the driving position at which the paper feed gear and the bail gear are meshed with each other or to the waiting position at which the idle lever is apart from both the paper feed gear and the bail gear; a return spring for urging the idle lever to return to the waiting position of the idle gear; and a compression piece provided on the carriage so as to engage the idle lever and move the idle gear to the driving position when the carriage is moved outside the printing range. This paper bailing apparatus is characterized by the fact that when the carriage is moved outside the printing range, the driving force of the paper feed gear is transmitted to the bail gear through the idle gear and the idle gear is self-held at the driving position by the paper feed gear driving force until the bail gear is moved to the bailing position.

According to this structure, the bail roller is manually moved to the release position at the time of inserting paper and held at that position by the toggle spring.

When the paper is inserted, the edge is accurately detected by a predetermined sensor or the like. When the paper is fed by a predetermined amount and the edge of the paper passes the position of the bail roller, the carriage moves to the outside of the printing range and the compression piece on the carriage forcibly moves the idle lever from the waiting position to the driving position. At this driving position, the idle gear meshes with the paper feed gear and the bail gear, so that the paper feeding force is transmitted to the bail gear so as to rotate the bail lever.

In this state, once the idle gear meshes with the paper feed gear and the bail gear at the driving position, even if the driving operation is stopped, the idle gear between the paper feed gear and the bail gear is not released even by the return force of the return spring and is self-held at the driving position.

Consequently, since the carriage need not keep pressing the idle lever at the driving position while the bail gear is meshed with the idle gear, it is possible to move the carriage to any given position, if necessary, for the purpose of centering or other purposes.

When the paper feed gear drives the bail gear through the idle gear, and the bail lever passes the neutral position of the toggle spring, the toggle spring instantly rotates the bail lever to the bailing position at which the bail roller is held against the platen. Since the driving force of the toggle spring secures the bailing position of the bail roller and the bail gear rotates at high speed prior to the idle gear, the idle gear cannot hold itself at the driving position in the driving gear train and is instead restored to the waiting position by the bail gear.

Thus, this paper bailing apparatus enables secure automatic bail driving operation by a simple structure and allows the carriage to move freely after it moves the bail lever to the driving position, because it is unnecessary to hold the bail lever by the carriage thereafter.

In another aspect of the present invention there is provided a paper bailing apparatus for a printer comprising: a platen for mounting paper thereon; a paper feed gear for rotating the platen; a carriage for carrying a printing head and reciprocating in the axial direction of the platen; a bail roller which is supported by a bail lever rockably supported by a printer frame and which holds the paper against the surface of the platen; a toggle spring for setting the rotation position of the bail roller either at the bailing position at which the bail roller is held against the platen or at the release position at which the bail roller is apart from the platen and for holding the bail lever at that position; a bail gear provided at the rocking supporting portion of the bail lever so as to receive the bail lever rocking force; an idle gear supported by a rotatable idle lever so as to be moved either to the driving position at which the paper feed gear and the bail gear are meshed with each other or to the waiting position at which the idle lever is apart from both the paper feed gear and the bail gear; a return spring for urging the idle lever to return to the waiting position of the idle gear; a positioning claw for positioning the rotational position of the idle gear held at the waiting position; and a compression piece provided on the carriage so as to engage the idle lever and move the idle gear to the driving position when the carriage is moved beyond the printing range. This paper bailing apparatus is characterized by the fact that when the carriage is moved beyond the printing range, the driving force of the paper feed gear is transmitted to the bail gear through the idle gear and the idle gear is self-held at the driving position by the gear driving force until the bail gear is moved to the bailing position.

According to this structure, the bail roller is manually moved to the release position at the time of inserting paper and is self-held at that position by the toggle spring. When the bail roller is released, the position claw provided on the bail gear is rotated integrally with the bail gear until it comes into contact with a tooth of the idle gear which is biased toward a stopper by the spring, thereby determining the rotational position of the idle gear and holding it at that position. When paper is inserted, the edge is accurately detected by a predetermined sensor or the like. When the paper is fed by a predetermined amount and the edge of the paper passes the position of the bail roller, the carriage moves beyond the printing range and the compression piece on the carriage forcibly moves the idle lever from the waiting position to the driving position. At the driving position, the idle gear meshes with the paper feed gear and the bail gear. Since the rotational position of the idle gear is set by the positioning claw in advance, the idle gear smoothly meshes with the paper feed gear and the bail gear without causing an interlocking error due to the butting of teeth of the gears. The paper feeding force is transmitted to the bail gear so as to rotate the bail lever. In this state, once the idle gear meshes with the paper feed gear and the bail gear at the driving position, even if the driving operation is stopped, the idle gear between the paper feed gear and the bail gear is not released even by the return force of the return spring and is self-held at the driving position. Consequently, since the carriage need not keep pressing the idle lever at the driving position while the bail gear is meshed with the idle gear, it is possible to move the carriage to any given position, if necessary, for the purpose of centering or any other purpose. When the paper feed gear drives the bail gear through the idle gear and the bail lever passes the neutral position of the toggle spring, the toggle spring instantly rotates the bail lever to the bailing position at which the bail roller is held against the platen. Since the driving force of the toggle spring secures the bailing position of the bail roller and the bail gear rotates at high speed prior to the idle gear, the idle gear cannot hold itself at the driving position in the driving gear train and is instead restored to the driving position by the bail gear. Thus, this paper bailing apparatus enables a secure automatic bail driving operation and allows the carriage to move freely after it moves the bail lever to the driving position, because it is not necessary to hold the bail lever by the carriage thereafter.

The above and other objects, features and advantages of the present invention will become clear from the following description of the preferred embodiments thereof, taken in conjunction with the accompanying drawings.

DESCRIPTION OF THE PREFERRED EMBODIMENTS

Preferred embodiments of the present invention will be explained in more detail with reference to the accompanying drawings.

Figure 1:
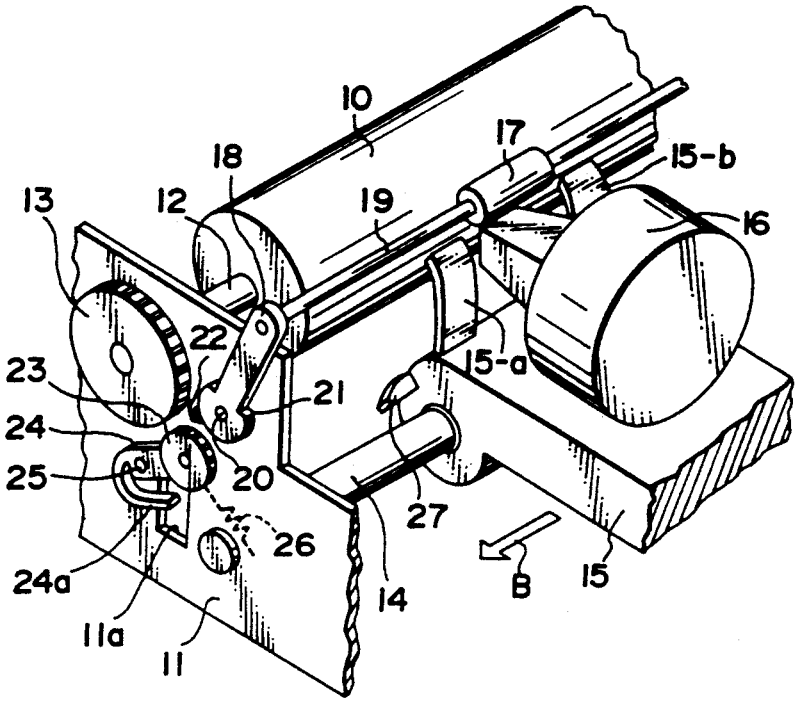
FIG. 1 is a perspective view of the main part of a first embodiment of a paper bailing apparatus for a printer according to the present invention.

FIG. 1 is a perspective view of the main part of a first embodiment of a paper bailing apparatus for a printer according to the present invention. A platen 10 is supported at both ends by a printer frame 11, as is known. A paper feed gear 13 is fixed to a platen shaft 12, and the driving force of the main motor (not shown) is transmitted to the paper feed gear 13.

A carriage stay 14 is fixed to the printer frame 11 in parallel with the platen shaft 12, and a carriage 15 is supported by the printer frame 11 through the carriage stay 14 in such a manner as to reciprocate on the carriage stay 14. The carriage 15 carries a printing head 16, as is known. The printing 16 head shown in FIG. 1 is composed of a wire dot head and executes the desired printing on the paper by driving the desired wires at the corresponding positions of the opposed platen while the carriage 15 is reciprocated. The reference numerals 15-*a* and 15-*b* represent paper guides provided on the carriage 15 on both sides of the printing head 16 so as to guide the paper along the platen.

In order to hold the paper in close contact with the platen 10, a bail roller 17 is rotatably provided on a roller shaft 19 so as to face the platen 10. The roller shaft 19 is supported by the end of a bail lever 18 which is supported by the printer frame 11 through a support shaft 20 in such a manner as to be rockable between the bailing position and the release position with respect to the platen 10.

This embodiment is characterized by the fact that the bail roller 17 is not only manually movable to the bailing position or the release position, but is also automatically driven by the force for driving the paper feed gear 13 from the release position shown in FIG. 1 to the bailing position at which the bail roller 17 is held against the platen 10. For this purpose, a bail gear 21 is provided at the rotary supporting end of the bail lever 18. In this embodiment, the bail gear 21 is composed of a sector gear of about a ¾ circle.

The bail lever 18 is self-held by a toggle spring 22 either at the release position shown in FIG. 1 or the bailing position at which the bail roller 17 is held against the platen 11.

An idle gear for transmitting the driving force of the paper feed gear 13 is rotatably supported at the rocking end of an idle lever 24 which is rotatably held by the printer frame 11 through a shaft 25. An elastic arm 24*a* extends from the base end of the idle lever 24 so as to engage a later-described compression piece of the carriage 15. A return spring 24 represented by the broken line in FIG. 1 is attached to the idle lever 24 so as to constantly bias the idle lever 24 clockwise in FIG. 1 by a weak biasing force.

A compression piece 27 having an inclined surface is provided at the left end of the carriage 15 in such a manner as to project from an opening 11*a* of the printer frame 11 and to compress the arm 24*a* of the idle lever 24.

Figure 6:
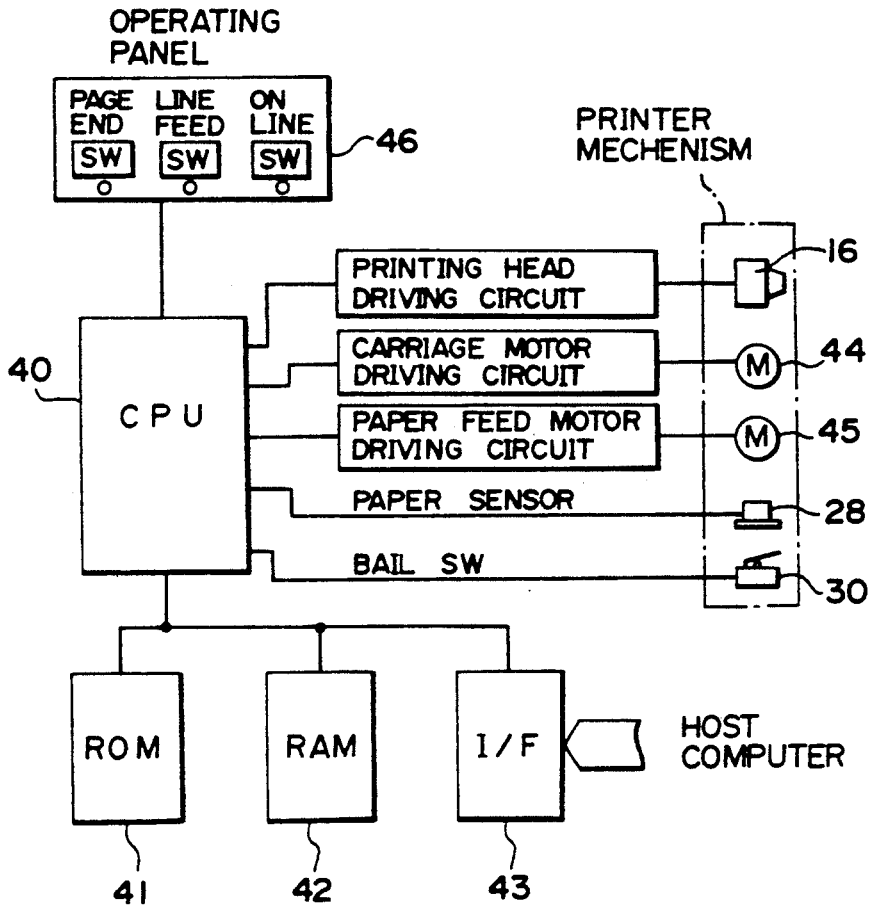
FIG. 6 is a block diagram of the mechanism of the controlling portion of the first embodiment.
Figure 7:
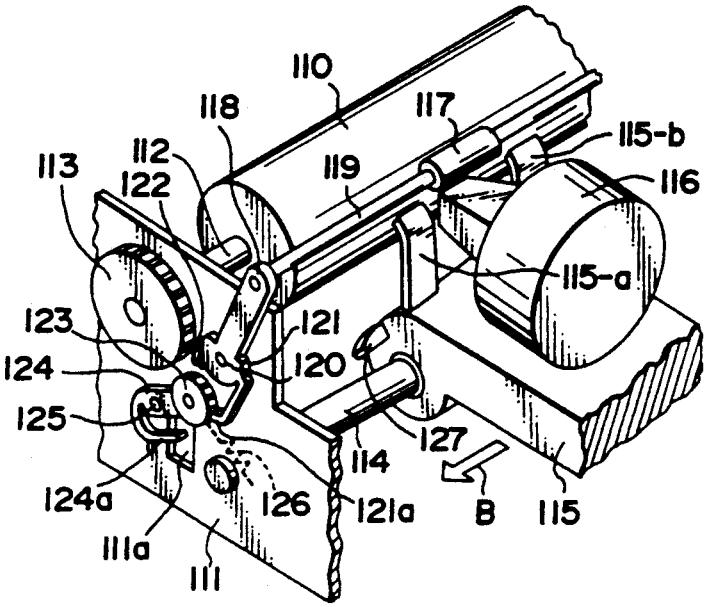
FIG. 7 is a perspective view of the main part of a second embodiment of a paper bailing apparatus for a printer according to the present invention.

FIG. 6 shows the structure of a controlling portion of this embodiment. A CPU 40 for controlling the printing operation or the paper feeding operation is connected to a ROM 41 for storing a control program and the like, a RAM 42 for storing printing data, operation data for printing, etc. which are received from a host computer, and an I/F (interface) 43 for connecting the printer to the host computer. The printing head 16, a carriage motor 44 and a paper feed motor 45 are also connected to the CPU through the respective driving circuits. The signals output from the paper sensor 28 and a bail SW 30 are input to the CPU 40 so that the respective states are monitored in accordance with the program, and commands such as "page end" and "line feed" are input from an operation panel 46 to the CPU 40.

The embodiment shown in FIG. 1 has the above-described structure. The bail lever driving operation will now be explained with reference to FIGS. 2 to 5, which show the respective operational states.

Figure 2:
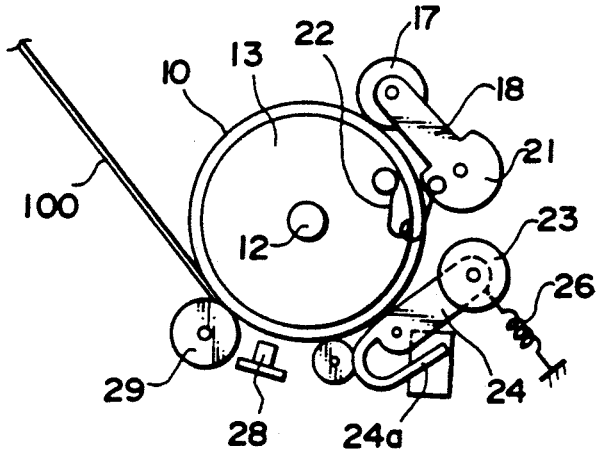
FIG. 2 is an explanatory view of the operation of the first embodiment immediately before paper is inserted.

FIG. 2 shows the printer in the state of commencing paper insertion. The bail roller 17 is at the bailing position at which the bail roller 17 is held against the platen 10. This state is maintained by the toggle spring 22. The idle gear 23 is rotated clockwise and held at the waiting position by the return spring 26. In this state, the idle gear 23 is held apart from both the paper feed gear 13 and the bail gear 21. At a paper slot, a pinch roller 29 is brought into contact with the platen 10, and paper 100 is inserted until the edge thereof hits the contacting portion between the pinch roller 29 and the platen 10.

Figure 3:
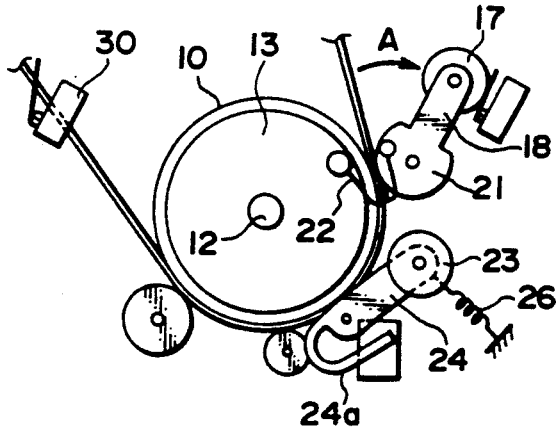
FIG. 3 is an explanatory view of the operation of the first embodiment in the state in which paper is inserted after the bail roller is manually released.

In this embodiment, the bail roller 17 is manually driven to the release position, as shown in FIG. 3. The bail roller 17 is manually moved in the direction indicated by the arrow A and held at this release position by the toggle spring 22. When the bail roller 17 is driven to the release position, the bail SW 30 is turned ON, and the paper feeding operation is started under the control of the CPU 40 which has received this signal. The paper feed motor 45 is first driven so as to feed the paper 100. The paper sensor 28 provided at a predetermined position detects the edge of the paper 100, and it is possible to constantly detect the accurate position of the edge of the paper 100 by counting the paper feed driving pulses thereafter. The paper 100 is fed by a predetermined amount in accordance with the printing starting position set by the user. When the setting operation of the paper is finished, the printer assumes the "on line" state. In this state, the edge of the paper 100 is positioned at the printing portion of the printing head, thereby enabling printing.

When the CPU 40 receives the printing command from the host computer, printing and line feeding are started. When printing and line feeding are executed for several lines and the paper 100 is fed by a predetermined amount since the paper sensor 28 detected the edge of the paper 100, the CPU 40 receives this signal and moves the bail roller 17 to the bailing operation.

Figure 4:
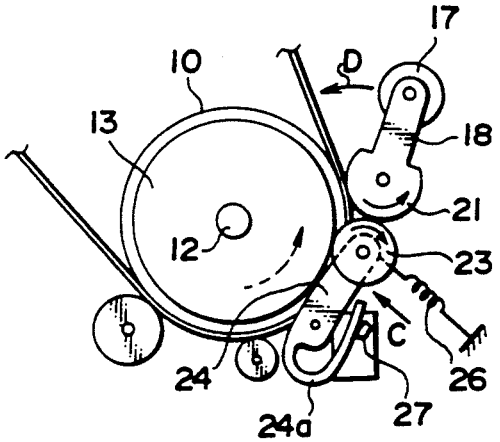
FIG. 4 is an explanatory view of the operation of the first embodiment in the state in which the idle gear is meshed with both the paper feed gear and the bail gear when the carriage is moved beyond the printing range.

In FIG. 4, the edge of the paper 100 has reached the predetermined position. In other words, the edge of the paper 100 has passed between the bail roller 17 and the platen 10 and reached the position which allows the bail roller 17 to be moved to the bailing position. The CPU 40 supplies a driving pulse to the carriage motor 44 so as to move the carriage 15 in the direction indicated by the arrow B in FIG. 1. When the carriage 15 passes the left margin of the printing range and stops on the left side thereof, the compression piece 27 of the carriage 15 engages the elastic arm 24*a* of the idle lever 24, as shown in FIG. 4, and its inclined surface pushes the arm 24*a* upward in the direction indicated by the arrow C. As a result, the idle gear 23 is moved to the position at which the idle gear 23 meshes with the paper feed gear 13 and the bail gear 21. In this state, the CPU 40 slightly rotates the paper feed motor 45 so as to normally rotate the paper feed gear 14. The slight rotation of the paper feed gear 13 ensures interlocking between the idle gear 23 and the paper feed gear 13 and between the idle gear 23 and the bail gear 21, thereby holding the idle gear 23 at the driving position. Therefore, even after the carriage 15, namely, the compression piece 27 leaves the arm 24*a*, the idle gear 23 maintains the state shown in FIG. 4.

It goes without saying that the biasing force of the return spring 26 is set to be weaker than the gear rotation holding force.

In this embodiment, since the arm 24*a* has elasticity, when the idle gear 23 is pressed by the compression piece 27 of the carriage 15, the extra force is nullified by the bending operation of the arm 24*a* so as to prevent unnecessary force from being applied to the idle gear 23.

The carriage 15 is then moved toward the center of the paper 100 and supports the slackened portion of the paper 100 by the paper guides 15-*a* and 15-*b* from the back surface in preparation for the subsequent bailing operation.

Figure 5:
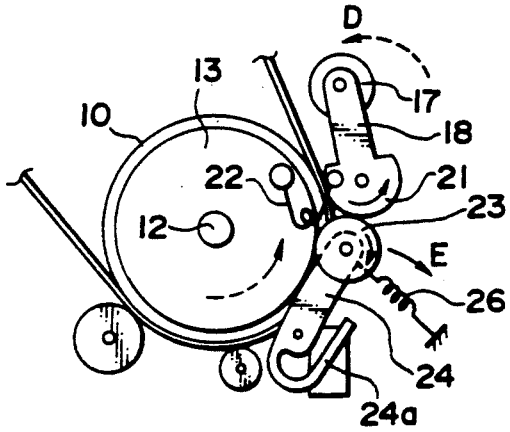
FIG. 5 is an explanatory view of the operation of the first embodiment in the state in which the bail lever is rapidly moved to the release position of the bail roller by the toggle spring and kicks back the idle gear.

FIG. 5 shows the operation of moving the bail lever 18 to the bailing position. When the paper feed motor 45 is normally rotated, the bail lever 18 is rotated in the direction indicated by the arrow D due to the driving force of the paper feed gear 13 transmitted by the idle gear 23. Approximately immediately after the bail lever 18 passes the neutral point of the toggle spring 22, the toggle spring 22 rapidly drives the bail lever 18 toward the position at which the bail roller 17 is held against the platen 10, so that the bail roller 17 itself together with the paper 100 securely moves toward the bailing position.

What is characteristic of this embodiment is that at this time the bail gear 21 kicks back the idle gear 23 toward the release position, as indicated by the arrow E, with the high-speed rotation of the bail lever 18. The idle lever 24 is quickly rotated to the waiting position both by the kickback force and the biasing force of the return spring 26.

More specifically, although the paper feed gear 13 will continue the rotation, the bail gear 21 cannot rotate any more when the bail roller 17 is pressed against the platen 10. The reaction between the paper feed gear 13 and the bail gear 21 kicks back the idle gear 23 in the direction indicated by the arrow E, so that the driving force of the paper feed gear 13 is not transmitted to the bail gear 21.

The state of the apparatus itself shown in FIG. 5 is therefore returned to the state shown in FIG. 2, but since the paper 100 is fed to the position at which the paper 100 is sandwiched between the bail roller 17 and the platen 10 unlike the position shown in FIG. 2, the bail roller 17 is securely restored to the bailing position.

The initializing operation of the printer when the power source is turned on will now be explained. When the power source is turned on, the paper feed motor 45 is slightly reversely rotated on the assumption that the idle lever 18 is held at the driving position. The slight reverse rotation of the paper feed motor 45 releases the interlock between the idle gear 23 and the paper feed gear 13 and between the idle gear 23 and the bail gear 21, and the bail lever 18 is restored to the waiting position and the clutch mechanism assumes the initiating state. The subsequent operations are carried out in the same way as in the known printer.

As described above, according to this embodiment, after the bail roller 17 is manually released, the paper feed driving force is effectively utilized as the bail lever driving force by the idle gear which is controlled by the carriage, and the bail roller is automatically returned to the bailing position.

According to the present invention, automatic restoration of the bail roller to the bailing position is secured by a simple structure.

In spite of the reduction in the number of parts and a simplified structure in comparison with a conventional mechanism, the paper bailing apparatus of the present invention can maintain the handling operability and prevents a part from being broken. As to the automatic paper setting operation, since the operation of the paper feed SW in a conventional printer is only replaced by a manual bail lever releasing operation in the paper bailing apparatus of the present invention, almost the same operability as in a fully automatic paper bailing apparatus which uses a driving source exclusively for the bail lever is realized. Thus, the present invention is very useful for practical use.

In addition, since it is possible to center the carriage the moment the bail lever is restored to the bailing position, it is possible to prevent the generation of skew.

Furthermore, the troublesome operations for initialization when the power source is turned on in a conventional mechanism which uses a cam for driving the bail lever are advantageously obviated.

A second embodiment of a paper bailing apparatus for a printer according to the present invention are shown in FIGS. 7 to 12. The elements corresponding to those in the first embodiment are indicated by the same numerals prefixed by the numeral 1, and explanation thereof will be omitted.

The second embodiment is characterized by a positioning claw 121*a* provided on a bail gear 121. The positioning claw 121*a* enables the rotation of an idle gear 123 to be stopped at a predetermined rotational position while a bail roller 117 is moved to the release position, and ensures interlocking between the idle gear 123 and a paper feed gear 113 and between the idle gear 123 and the bail gear 121 when the idle gear 123 moves from the waiting position to the driving position.

The bail lever driving operation is basically the same as that in the first embodiment. Only the operation characteristic of the second embodiment will be explained hereinunder.

Figure 8:
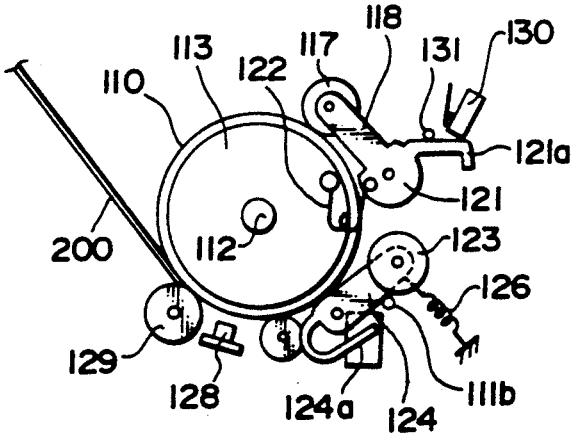
FIG. 8 is an explanatory view of the operation of the second embodiment immediately before paper is inserted.

FIG. 8 shows the printer in the state of commencing paper insertion. The bail roller 117 is at the bailing position at which the bail roller 117 is held against the platen 110. The idle gear 123 is held at the waiting position, but since the idle gear can freely rotate in this state, the idle gear 123 is not always stopped at the position at which teeth of the idle gear 123 mesh with teeth of the bail gear 121 in the optimal state. In an extreme case, the teeth may butt with each other when it is attempted to mesh them together. In such a case, there is a possibility of a malfunction of the printer or damage to the teeth of the gears.

In this embodiment, such inconveniences are eliminated by the positioning claw 121*a* which can integrally rotate with the bail lever 118 around a support shaft 120.

In the state shown in FIG. 8, in order to insert paper, the bail roller 117 is moved to the release position. In this embodiment, the release position is set at the position at which the bail lever 118 comes into contact with a stopper 131.

Figure 9:
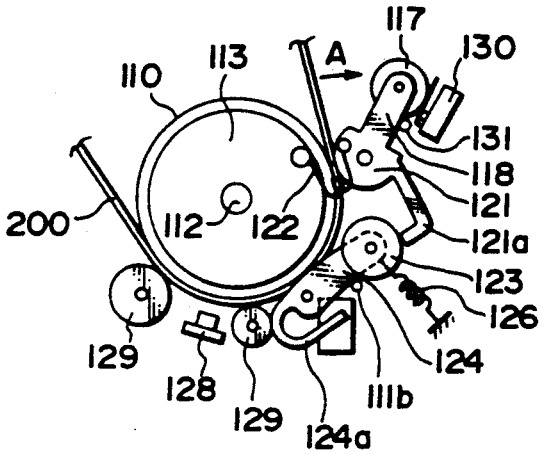
FIG. 9 is an explanatory view of the operation of the second embodiment in the state in which paper is inserted after the bail roller is manually released.
Figure 12:
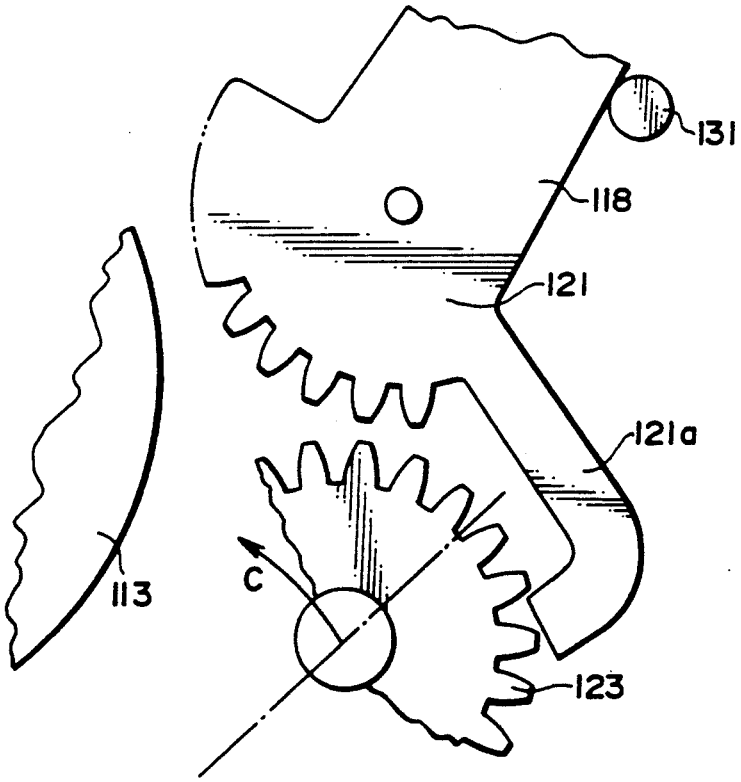
FIG. 12 is a partially enlarged view of the second embodiment shown in FIG. 9.

FIG. 9 shows the release position and FIG. 12 shows the idle gear 123 and the positioning claw 121*a* in the interlocked state. The forward end portion of the positioning claw 121*a* provided on the bail gear 121 is brought into contact with a tooth of the idle gear 123 at the waiting position so as to stop the rotation of the idle gear 123 at a predetermined rotational position. The predetermined rotational position is the position which ensures the interlocking between teeth of the idle gear 123 and teeth of the bail gear 121 when the idle lever 124 is rocked. In this embodiment, the waiting position of the idle lever 124 is determined by a stopper 111*b*.

Figure 10:
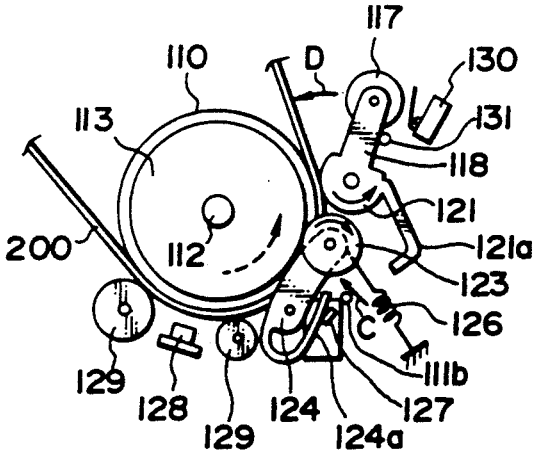
FIG. 10 is an explanatory view of the operation of the second embodiment in the state in which the idle gear is meshed with both the paper feed gear and the bail gear when the carriage is moved beyond the printing range.

FIG. 10 shows this embodiment in the state in which the edge of the paper 200 reaches a predetermined position. In this state, the edge of the paper 200 has passed the bail roller 117 and the platen 110, and at this point of time, the bailing operation is requested. In the same way as in the first embodiment, a carriage motor 144 is driven by the operation of a CPU 140, and the carriage 115 is moved in the direction indicated by the arrow A in FIG. 7. A compression piece 127 of the carriage 115 engages an elastic arm 124*a* of the idle lever 124, as shown in FIG. 10, and the compression piece's inclined surface pushes the arm 124*a* in the direction indicated by the arrow C, thereby moving the idle gear 123 to the position at which it meshes with both the paper feed gear 113 and the bail gear 121.

At this time, since the idle gear 123 meshes with the paper feed gear 113 and the bail gear 121 (by moving in the direction indicated by the arrow C) after the rotational position is set at the predetermined position, smooth interlocking free from an interlocking error due to the butting of teeth of the gears is enabled. In this state, the CPU 140 slightly rotates the paper feed motor 145 so as to normally rotate the paper feed gear 113. The slight rotation of the paper feed gear 113 ensures interlocking between the idle gear 123 and the paper feed gear 113 and between the idle gear 123 and the bail gear 121, thereby holding the idle gear 123 at the driving position. Therefore, even after the carriage 115, namely, the compression piece 127 leaves the arm 124*a*, the idle gear 123 maintains the state shown in FIG. 10.

Figure 11:
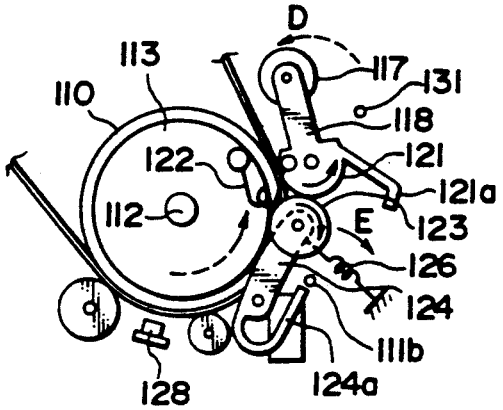
FIG. 11 is an explanatory view of the operation of the second embodiment in the state in which the bail lever is rapidly moved to the release position of the bail roller by the toggle spring and kicks back the idle gear.

It goes without saying that the carriage 115 is returned to the central position of the paper 200 and the bail gear 121 kicks back the idle gear 123 in the direction indicated by the arrow E in FIG. 11 in the same way as in the first embodiment. More specifically, although the paper feed gear 113 will continue the rotation, the bail gear 121 cannot rotate any more when the bail roller 117 is held against the platen 110. The reaction between the paper feed gear 113 and the bail gear 121 kicks back the idle gear 123 in the direction indicated by the arrow E, so that the driving force of the paper feed gear 113 is not transmitted to the bail gear 121.

Although the positioning claw 121*a* is integrally provided with the bail gear 121 and the positioning claw 121*a* positions the idle gear 123 by the operation of driving the bail lever 118 in this embodiment, the method of positioning the rotational position of the idle gear 123 is not restricted to the above-described method. For example, a pin or the like may be implanted at a position of the base frame 111 at which the pin or the like is brought into contact with a tooth of the idle gear 123, and the rotational position of the idle gear 123 may be set by moving the idle lever 124 to the waiting position.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A paper bailing apparatus for a printer comprising:
- a platen for mounting paper thereon;
- a paper feed gear for rotating said platen;
- a carriage for carrying a printing head and reciprocating in the axial direction of said platen;
- a bail roller supported by a rockable bail lever so as to hold said paper against the surface of the platen;
- a toggle spring for setting said bail lever either at the bailing position at which said bail roller is held against said platen or at the release position at which said bail roller is apart from said platen and for maintaining said bail lever at that position;
- a bail gear provided at the rocking supporting portion of said bail lever so as to receiver the bail lever rocking force;
- an idle gear supported by a rotatable idle lever so as to be moved either to the driving position at which said idle gear meshes with both said paper feed gear and said bail gear or to the waiting position at which said idle lever is apart from both said paper feed gear and said bail gear;
- a return spring for urging said idle lever to return to said waiting position of said idle gear; and
- a compression piece provided on said carriage so as to engage said idle lever and move said idle gear to said driving position when said carriage is moved beyond the printing range;
- wherein when said carriage is moved beyond said printing range, the driving force of said paper feed gear is transmitted to said bail gear through said idle gear, and said idle gear is self-held at the driving position by the gear driving force until said bail gear is moved to said bailing position.

2. A paper bailing apparatus for a printer according to claim 1, wherein said bail gear is composed of a sector gear.

3. A paper bailing apparatus for a printer according to claim 1, wherein said idle lever is provided with an elastic arm which extends from the base end thereof and said compression piece engages said elastic arm.

4. A paper bailing apparatus for a printer according to claim 1, wherein said compression piece provided on said carriage projects from an opening provided in a printer frame so as to engage said idle lever which is provided on the outside of said printer frame.

5. A paper bailing apparatus for a printer comprising:
- a platen for mounting paper thereon;
- a paper feed gear for rotating said platen;
- a carriage for carrying a printing head and reciprocating in the axial direction of said platen;
- a bail roller which is supported by a bail lever rockably supported by a printer frame and which holds the paper against the surface of said platen;
- a toggle spring for setting the position of said bail lever either at the bailing position at which said bail roller is held against said platen or at the release position at which said bail roller is apart from said platen and for maintaining said bail lever at that position;
- a bail gear provided at the rocking supporting portion of said bail lever so as to receive the bail lever rocking force;
- an idle gear supported by a rotatable idle lever so as to be moved either to the driving position at which said paper feed gear and said bail gear are meshed with each other or to the waiting position at which said idle lever is apart from both said paper feed gear and said bail gear;
- a return spring for urging said idle lever to return to said waiting position of said idle gear;
- a positioning claw for positioning the rotational position of said idle gear maintained at said waiting position; and
- a compression piece provided on said carriage so as to engage said idle lever and move said idle gear to said driving position when said carriage is moved beyond the printing range;
- wherein when said carriage is moved beyond said printing range, the driving force of said paper feed gear is transmitted to said bail gear through said idle gear, and said idle gear is self-held at the driving position by the gear driving force until said bail gear is moved to said bailing position.

6. A paper bailing apparatus for a printer according to claim 5, wherein said bail gear is composed of a sector gear.

7. A paper bailing apparatus for a printer according to claim 5, wherein said idle lever is provided with an elastic arm which extends from the base end thereof and said compression piece engages said elastic arm.

8. A paper bailing apparatus for a printer according to claim 5, wherein said compression piece provided on said carriage projects from an opening provided in a printer frame so as to engage said idle lever which is provided on the outside of said printer frame.

* * * * *